United States Patent [19]

Shibuya et al.

[11] Patent Number: 4,810,177

[45] Date of Patent: Mar. 7, 1989

[54] VANE COMPRESSOR WITH VANE BACK PRESSURE ADJUSTMENT

[75] Inventors: Tsuneori Shibuya; Yutaka Ishizuka; Haruhiko Takada; Teruo Nakamura; Hidehiko Takayama, all of Saitama, Japan

[73] Assignee: Diesel Kiki Co., Ltd., Tokyo, Japan

[21] Appl. No.: 108,438

[22] Filed: Oct. 13, 1987

Related U.S. Application Data

[62] Division of Ser. No. 874,555, Jun. 16, 1986, Pat. No. 4,717,321, which is a division of Ser. No. 640,312, Aug. 13, 1984, Pat. No. 4,611,977, which is a division of Ser. No. 502,666, Jun. 9, 1983, Pat. No. 4,571,164.

[30] Foreign Application Priority Data

Jun. 18, 1982 [JP] Japan ..... 57-91163[U]

[51] Int. Cl.[4] ..... F04C 18/344; F04C 29/02

[52] U.S. Cl. ..... 418/76; 418/82; 418/93; 418/268

[58] Field of Search ..... 418/76, 82, 93, 267, 418/268

[56] References Cited

U.S. PATENT DOCUMENTS

| | | | |
|---|---|---|---|
| 2,275,774 | 3/1942 | Kraissl, Jr. | 418/76 |
| 2,522,824 | 9/1950 | Hicks | 418/93 |
| 2,809,593 | 10/1951 | Klessig et al. | 418/82 |
| 3,447,477 | 1/1969 | Pettibone | 418/80 |
| 3,480,204 | 11/1969 | Harlin | 418/82 |
| 3,598,510 | 8/1971 | Aoki | 418/82 |
| 3,852,003 | 12/1974 | Adalbert et al. | 418/93 |
| 3,869,231 | 3/1975 | Adams | 418/267 |
| 3,973,881 | 8/1976 | Melchinger | 418/82 |
| 4,104,010 | 8/1978 | Shibuya | 418/268 |
| 4,342,547 | 8/1982 | Yamada et al. | 418/93 |
| 4,403,929 | 9/1983 | Nagasaku et al. | 418/93 |

FOREIGN PATENT DOCUMENTS

| | | | |
|---|---|---|---|
| 49-26522 | 7/1974 | Japan . | |
| 57-20853 | 5/1982 | Japan . | |
| 57-102592 | 6/1982 | Japan | 418/93 |
| 57-129283 | 8/1982 | Japan | 418/93 |

*Primary Examiner*—John J. Vrablik

*Attorney, Agent, or Firm*—Frishauf, Holtz, Goodman & Woodward

[57] ABSTRACT

A vane compressor has a vane back pressure adjustment device including back-pressure chambers defined in a vane-supporting rotor and surrounded by vanes and side blocks secured to axial ends of a cylinder. The back-pressure chamber has axial ends disposed to follow a path against each of the side blocks when the rotor rotates. The path is divided into at least one high-pressure zone in which the vanes move across a pump outlet defined in the cylinder, and at least one normal-pressure zone which is the remainder of the path. In the normal-pressure zone, oil grooves defined in surfaces of the side blocks which face the rotor and supplied with oil from an oil sump in the vane compressor are in communication with the back-pressure chambers, to thereby maintain the oil pressure in the back-pressure chambers at a pressure level in the oil sump. In the high-pressure zone, the back-pressure chambers are out of communication with the oil grooves so that the oil fed into the back-pressure chambers is confined therein, except through a restrictor means. When the vanes move across the pump outlet, the vanes enter the high-pressure zone to trap oil in the back-pressure chambers to thereby elevate the oil pressure in the back-pressure chambers to a high level. Therefore, the vanes are prevented from being retracted deeply into vane slits in the rotor and then popping out into hitting engagement with the cylinder.

1 Claim, 6 Drawing Sheets

VANE COMPRESSOR WITH VANE BACK PRESSURE ADJUSTMENT

This is a division of application Ser. No. 874,555 filed June 16, 1986, now U.S. Pat. No. 4,717,321, in turn is a division of Ser. No. 640,312 filed Aug. 13, 1984, now U.S. Pat. No. 4,611,977 issued 9/16/86 which in turn is a division of Ser. No. 502,666 filed June 9, 1983 (now U.S. Pat. No. 4,571,164).

BACKGROUND OF THE INVENTION

The present invention relates to a vane compressor for compressing a gas such as a refrigerant gas, and more particularly to an arrangement for adjusting back pressure acting on vanes in such a vane compressor.

Vane compressors have a compressor body composed generally of a pair of side blocks securely mounted on both sides of a cylinder. A rotor with a plurality of vanes fitted in slits defined therein is disposed in the compressor body, the vanes and the rotor jointly defining compression chambers in the compressor body. Rotation of the rotor causes distal ends of the vanes to slide against the inner peripheral surface of the cylinder, thereby enlarging and reducing the volumes of the compression chambers for compressing a gas therein. During operation of the vane compressor, it is necessary that the compression chambers be sealed by the distal ends of the vanes slidably pressed against the inner peripheral surface of the cylinder. To meet this requirement, the vanes are pushed radially outwardly under centrifugal forces acting thereon as well as by high-pressure oil supplied from an oil sump into back-pressure chambers defined between radially inward ends of the vanes and the vane slits in the rotor. In operation, the vanes will be retracted deeply into the vane slits when they move across a pump outlet defined in the cylinder against the back pressure on the vanes. After the vanes have moved past the pump outlet, they will be thrust out into hitting engagement with the inner peripheral surface of the cylinder, thus causing noise referred to as chattering.

SUMMARY OF THE INVENTION

It is an object of the present invention to provide a vane compressor having a vane back pressure adjustment capability for preventing chattering due to a negative vane thrusting force when a force acting on the vane toward the lower or radially inward end thereof is increased as the vane moves across a pump outlet.

According to the present invention, a vane compressor has a vane back pressure adjustment device including back-pressure chambers defined in a vane-supporting rotor and surrounded by vanes and side blocks secured to opposite axial ends of a cylinder. The back-pressure chambers each have opposite axial ends disposed to follow a path against each of the side blocks during rotation of the rotor. The path is divided into at least one high-pressure zone in which the vanes move across a pump outlet defined in the cylinder, and at least one normal-pressure zone. In the normal-pressure zone, oil grooves which are defined in opposite inner end surfaces of the side blocks which face the rotor and are supplied with oil from an oil sump in the vane compressor, are in communication with the back-pressure chambers so as to introduce oil in the oil grooves into the back-pressure chambers, to thereby maintain the oil pressure in the back-pressure chambers at a pressure level in the oil sump. In the high-pressure zone, the back-pressure chambers are out of communication with the oil grooves so that the oil fed into the back-pressure chambers is confined therein while being compressed therein as the rotor rotates, except that a fraction of the confined oil is leaked through a restrictor means. When the vanes move across the pump outlet, the vanes enter the high-pressure zone to trap oil in the back-pressure chambers to thereby elevate the oil pressure in the back-pressure chambers to a high level. In the high-pressure zone, as the rotor rotates, the vanes are subjected to a large force directed toward the distal ends thereof and counteracting a force directed toward the radially inward ends of the vanes. Therefore, the thrusting forces acting on the vanes are prevented from going negative when the vanes move across the pump outlet, thus holding the vanes from being retracted and then popping out against the cylinder.

The above and other objects, features and advantages of the present invention will become more apparent from the following description when taken in conjunction with the accompanying drawings in which preferred embodiments of the present invention are shown by way of illustrative example.

DETAILED DESCRIPTION

Figure 1:
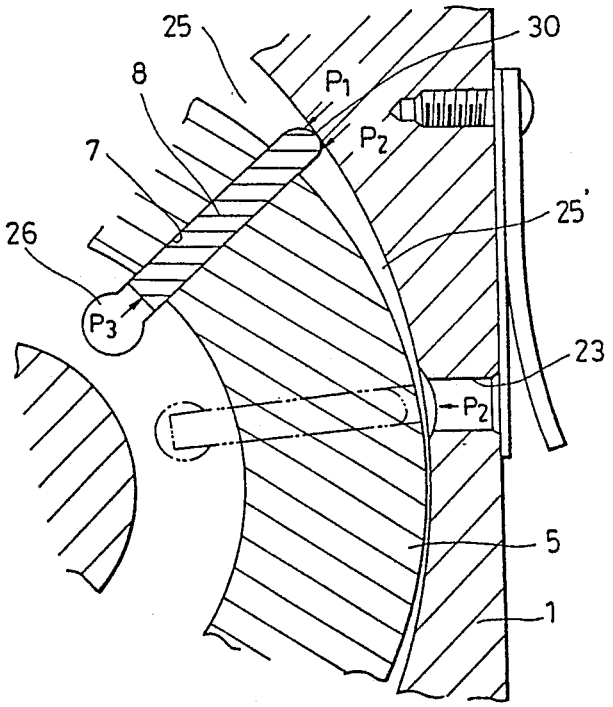
FIG. 1 PRIOR ART
FIG. 1 is a fragmentary cross-sectional view of a conventional vane compressor, illustrating the cause of chattering.

FIG. 1 shows a conventional vane compressor in fragmentary cross section. In the illustrated position, a vane rotating with a rotor 5 is approaching a pump outlet 23 defined in a cylinder 1. The vane 8 has a distal end held in contact with an inner peripheral surface of the cylinder 1 at a point of contact 30. A chamber in the cylinder 1 is divided by the contact point 30 into a compression chamber 25 which has just started its compression stroke and another compression chamber 25' which has reached a substantially intermediate position in its compression stroke. The tip end of the vane 8 which is held against the cylinder bore wall is displaced circumferentially off a central axis of the vane 8. It is assumed that the distal end of the vane 8 is divided by the contact point 30 into a first region having a vertically projecting area A1 and a second region having a vertically projecting area A2, and that pressures P1, P2 are developed in the compression chambers 25, 25', respectively. The vane 8 is now subjected to a force (P1A1+P2A2) directed toward its radially inner end. The radially inner end face of the vane 8 and a vane slit 7 with the vane 8 fitted therein jointly define a back-pressure chamber 26 in which high-pressure oil acts under a pressure of P3. With the radially inner end face of the vane 8 having an area of A3, the vane 8 undergoes a pressure of P3A3 directed toward the distal end of the vane 8. Accordingly, the vane 8 is pressed against the cylinder 1 with a pushing force F=P3A3−(-P1A1+P2A2) on condition that the centrifugal forces acting on the vane 8 are negligible. Since the area A2 on which the larger force P2 is imposed is relatively small, the condition F>0 holds and consequently the distal end of the vane 8 is considered to be in a state of balance while being pressed against the inner peripheral surface of the cylinder 1. When the vane 8 is angularly displaced to the opening of the pump outlet 23, the contact point 30 disappears and the vane 8 is subjected to a force P2(A1+A2) directed toward the radially inner end thereof, with the result that the pushing force F is expressed by F=P3A3−P2(A1+A2). This means that F can be negative, that is F<0. When the force F is rendered negative, the vane 8 is retracted back into the vane slit 7 as the vane 8 moves across the pump outlet 23, as indicated by the two-dot chain line in FIG. 1. After the vane 8 has moved past the pump outlet 23, the pushing force F is increased again. This causes unwanted chattering.

The present invention will now be described with reference to FIGS. 2 through 8.

Figure 2:
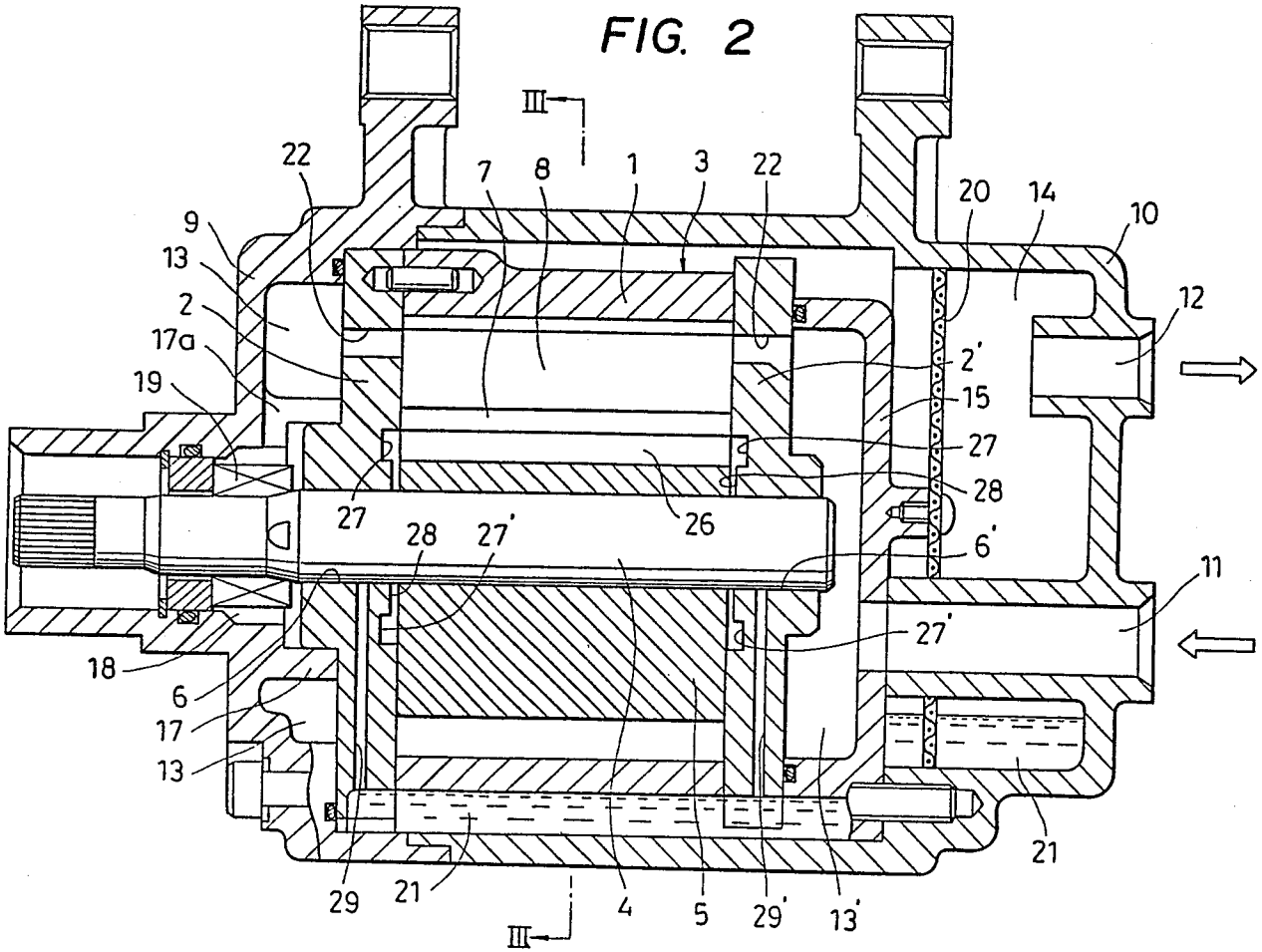
FIG. 2 is a vertical cross-sectional view of a vane compressor according to a first embodiment of the present invention.
Figure 3:
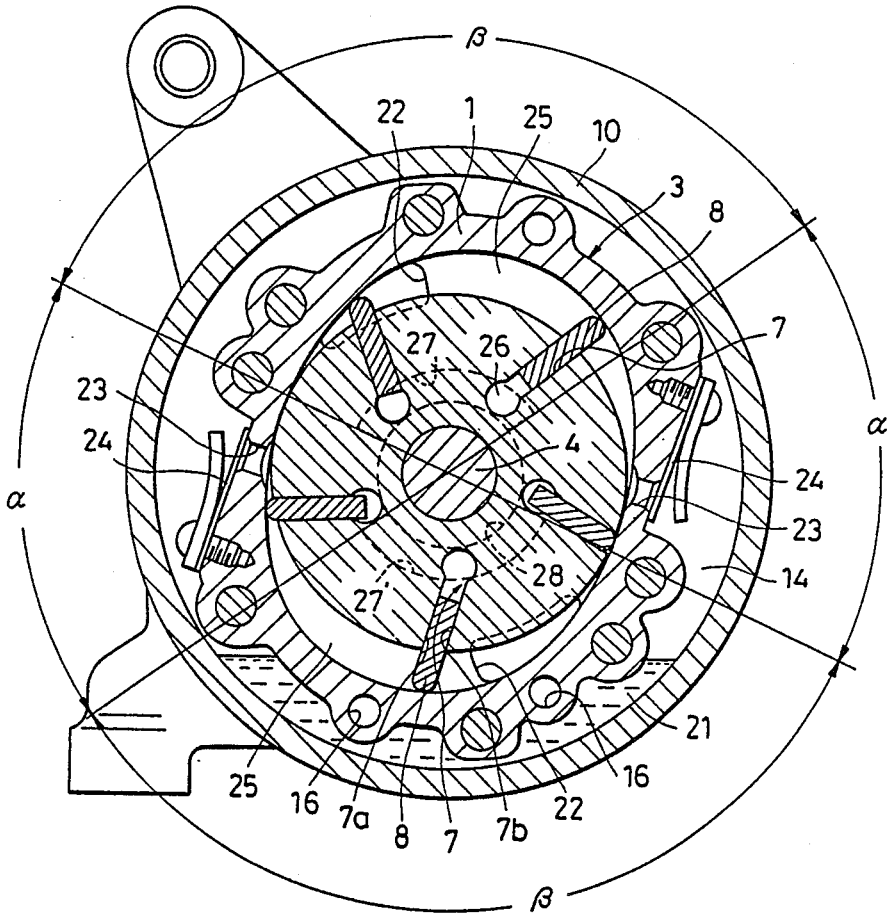
FIG. 3 is a cross-sectional view taken along line III—III of FIG. 2.
Figure 4:
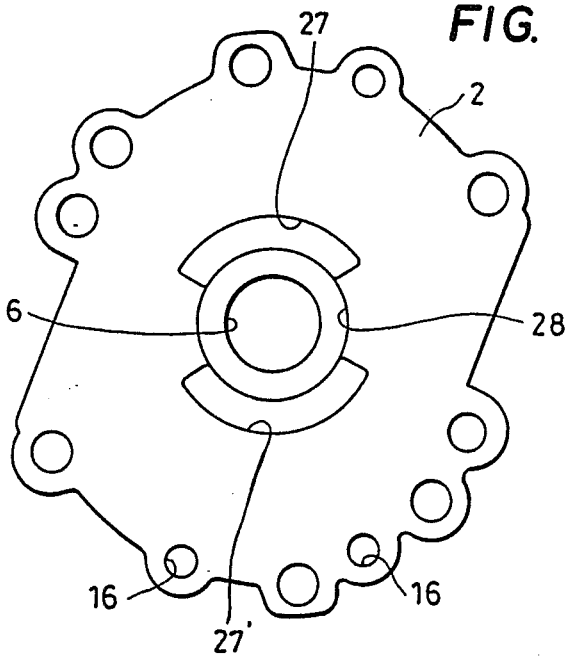
FIG. 4 is a front elevational view of a side block in the vane compressor of FIG. 2.

FIGS. 2 through 4 show a vane compressor according to a first embodiment of the present invention. The vane compressor is of the multiple-vane type having a cylinder 1 of elliptical or oval-shaped cross section and a pair of opposite side blocks 2, 2' fastened to the cylinder 1 at its opposite axial ends, the cylinder 1 and the side blocks 2, 2' jointly constituting a compressor body or pump housing 3.

A cylindrical rotor 5 with a drive shaft 4 extending coaxially therethrough and firmly fixed thereto is disposed in the compressor body 3. The drive shaft 4 is rotatably journalled in bearing holes 6, 6', respectively, defined in the side blocks 2, 2'.

The rotor 5 is spaced from two diametrically opposite smaller-diameter portions of the inner peripheral surface of the cylinder 1 with small clearances left therebetween. The rotor 5 has end surfaces also spaced through small clearances from the side blocks 2, 2', respectively. The rotor 5 has a plurality of, for example five, vane slits 7 defined therein and extending substantially radially thereof, the vane slits 7 being circumferentially angularly spaced at a constant angular interval. Vanes 8 are slidably fitted respectively in the vane slits 7.

The compressor body 3 is housed jointly in a head 9, securely mounted on one of the side blocks 2, and a shell 10 securely mounted on the head 9. The shell 10 has an inlet port 11 and an outlet port 12 opening through a rear wall thereof. The inlet and outlet ports 11, 12 are held in communication with low-pressure and high-pressure chambers 13', 14, respectively. The low-pressure chamber 13' is separated from the high-pressure chamber 14 by a cover 15 securely attached to the side block 2'. The low-pressure chamber 13' communicates with another low-pressure chamber 13 in the head 9 through holes 16 defined in the cylinder 1 and the side blocks 2, 2'. The low-pressure chamber 13 in the head 9 communicates with a sealing chamber 18 also defined in the head 9 by a partition 17 formed integrally therewith, through an opening 17*a* formed in the partition 17. The sealing chamber 18 is sealed in a gas-tight manner from the exterior by a sealing device 19 housed in the sealing chamber 18 and interposed between a portion of the drive shaft 4 projecting out of the side block 2 and the head 9. The high-pressure chamber 14 is defined between the compressor body 3 and the shell 12 and has an oil separator plate 20 mounted therein. A lower portion of the high-pressure chamber 14 serves as an oil sump 21.

The low-pressure chambers 13, 13' are held in communication with the interior of the compressor body 3 through two pump inlets 22 defined in each of the side blocks 2, 2'. The high-pressure chamber 14 is held in communication with the interior of the compressor body 3 through pump outlets 23 defined in side walls of the cylinder 1. The pump inlets 22 in each side block are substantially diametrically opposite to each other. The pump outlets 23 are normally closed by reed-shaped outlet valves 24, respectively, and positioned adjacent to the smaller-diameter portions of the cylinder 1. The compressor body 3, the rotor 5 and the vanes 8 jointly define compression chambers 25, which are brought into alternate communication with the high-pressure chamber 14 through the pump outlets 23 and the outlet valves 24 upon rotation of the rotor 5. While the rotor 5 is in rotation, the vanes 8 are pressed against the inner peripheral surface of the cylinder 1 under centrifugal forces acting on the vanes 8 and back pressure from the back-pressure chambers 26. Therefore, the adjacent compression chambers 25 are sealed from each other by the vanes 8 during operation.

Each of the back-pressure chambers 26 is defined deeply in the vane slit 7 and surrounded by the rotor 5, the vane 8 and the side blocks 2, 2', with their opposite axial ends opening in the end surfaces of the rotor 5. The pressure build-up within each back-pressure chamber 26 can be adjusted by a back-pressure adjustment device as the rotor 5 rotates.

The back-pressure adjustment device is incorporated in each of the side blocks 2, 2'. On rotation of the rotor 5, the axial ends of each back-pressure chamber 26 follow a path (a circular path in the illustrated embodiment) against the side blocks 2, 2'. The path of rotation can be circumferentially divided into a pair of diametrically opposite high-pressure angular zones $\alpha$ and a pair of diametrically opposite normal pressure angular zones $\beta$, as shown in FIG. 3. In each high-pressure angular zone $\alpha$, the vane 8 moves across the pump outlet 23. Each high-pressure angular zone $\alpha$ angularly extends from a trailing end of the back-pressure chamber 26 positioned when an extension of a leading side 7*a* of the vane slit 7 is located immediately in front of the opening edge of the pump outlet 23, to a leading end of the back-pressure chamber 26 positioned when a trailing side 7*b* of the vane slit 7 has just moved past the smaller-diameter portion of the inner peripheral surface of the cylinder 1. The terms "leading" and "trailing" are used herein with reference to the direction of rotation of the rotor 5. The normal-pressure angular zones $\beta$ are constituted by the remaining angular intervals. The side blocks 2, 2' have arcuate oil grooves 27, 27' formed in their inner end surfaces facing the rotor 5 and extending from one end to the other of the normal-pressure angular zones $\beta$. The oil grooves 27, 27' are held in communication with the bearing holes 6, 6' through annular oil guide grooves 28 defined radially inwardly of the oil grooves 27, 27'. The bearing holes 6, 6' communicate with the oil sump 21 via oil supply holes 29, 29' formed in the side blocks 2, 2', respectively. Therefore, the oil grooves 27, 27' are supplied with high-pressure oil through clearances around the drive shaft 5 within the bearing holes 6, 6'. In each of the normal-pressure zones $\beta$, the ends of the back-pressure chamber 26 fully confront the oil grooves 27, 27', so that the pressure of oil in the oil grooves 27, 27' is introduced into the back-pressure chamber 26. In each of the high-pressure zones $\alpha$, however, the back-pressure chamber 26 is severed from the oil grooves 27, 27' and hence rendered independent from the oil supply system except through a restrictor means composed of the clearances between the side blocks 2, 2' and the rotor 5. Consequently, the oil is confined in the back-pressure chamber 26 in the high-pressure zone $\alpha$.

The vane compressor operates in the following manner. When the drive shaft 4 is rotated, the rotor 5 and the vanes 8 rotate together in the compressor body 3. While each compression chamber 25 is being enlarged, the gas is drawn through the pump inlet 22 into the compression chamber 25. As the compression chamber 25 is progressively reduced in volume, the gas contained therein is compressed and the compressed gas is discharged through the pump outlet 23, opening the outlet valve 24, into the high-pressure chamber 14. Such suction and compression strokes are repeated to discharge the compressed gas. The gas which has egressed into the high-pressure chamber 14 is temporarily stored therein, thereby pressurizing the high-pressure chamber 14. The oil from the oil sump 21 is then fed upwardly through the oil supply holes 29, 29' into the bearing holes 6, 6'. The oil thus supplied to the bearing holes 6, 6' is restricted by the clearance between the drive shaft 4 and the bearing holes 6, 6', and led into the oil grooves 27, 27' via the oil guide grooves 28, though a fraction of the oil is also supplied to the sealing chamber 18 through the above clearance.

Since the ends of the back-pressure chambers 26 are kept in communication with the oil grooves 27, 27' in each normal-pressure zone $\beta$, the pressure P in the back-pressure chamber 26 is made equal to the pressure P3 in the oil grooves 27, 27'. As the leading ends of the back-pressure chambers 26 start entering the high-pressure zone $\alpha$, their areas confronting the oil grooves 27, 27' become progressively smaller until the back-pressure chambers 26 are finally separated from the oil grooves 27, 27', whereupon the oil is confined in the back-pressure chambers 26. At the same time, the vanes 8 are gradually pushed back by the inner peripheral surface of the cylinder 1 to reduce the volumes of the back-pressure chambers 26 and, hence, compress (i.e., pressurize) the oil trapped therein. The oil is kept confined while being compressed in the back-pressure chambers 26 except that a small fraction of the oil leaks to the oil grooves 27, 27', etc. through the restrictor means constituted of the clearances between the side blocks 2, 2' and the rotor 5. The pressure P in the back-pressure chambers 26 or that of the confined oil therein, therefore, increases up to a high pressure P4. The vanes 8 then move past the smaller-diameter portions of the inner peripheral surface of the cylinder 1 while at the same time the vanes 8 are pushed radially outwardly under the pressure P4. The resulting force P4A3 enables the vanes 8 to counteract the large force P2 (A1+A2) acting thereon toward their radially inward ends at the time the vanes 8 moves across the pump outlets 23, preventing the vanes 8 from being retracted back into the vane slits 7. After the vanes 8 have moved past the smaller-diameter portions of the cylinder 1, the ends of the back-pressure chambers 26 re-enter the normal-pressure zones $\beta$ in which the back-pressure chambers 26 communicate with the oil grooves 27, 27'. The pressure P in the back-pressure chambers 26 is now lowered to the oil pressure P3 in the oil grooves 27, 27'.

As noted above, in the high-pressure zones $\alpha$, the oil trapped in the back-pressure chambers 26 is compressed to create a high pressure build-up therein. The restrictor means serves to prevent the vanes 8 from being excessively pressed against the cylinder 1, which would result in a power loss, seizure, or other malfunctions. Various other restrictor means may be designed. FIGS. 5 through 8 illustrate such various restrictor means by way of example.

Figure 5:
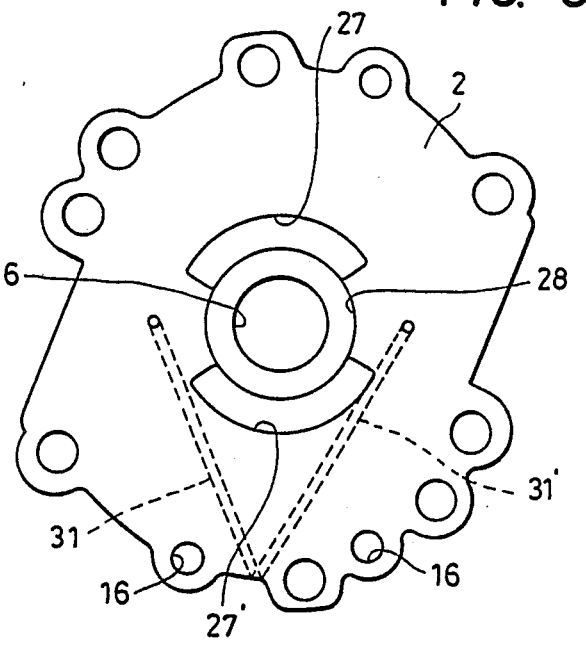
FIG. 5 is a front elevational view of a side block according to a second embodiment of the present invention.

As shown in FIG. 5, a restrictor means is incorporated in each of side blocks 2, 2' according to a second embodiment of the invention. The restrictor means is composed of a pair of restriction passages 31, 31' defined in each side block 2, 2', as well as a clearance between each side block and the rotor 5. Each of the restriction passages 31, 31' has one end opening in the high-pressure zone $\alpha$ in a position radially outward of the oil grooves 27, 27' and communicating with the clearances between the side blocks 2, 2' and the rotor 5. The other end of each restriction passage 31, 31' opens at the lower end of the side block 2, 2' and communicates with the oil sump 21. A fraction of oil compressed in the back-pressure chambers 26 in the high-pressure zones $\alpha$ is restricted by the clearances between the side blocks 2, 2' and the rotor 5 and the restriction passages 31, 31' and then returns to the oil sump 21. Only one of the restriction passages 31, 31' may be provided, and the other may be eliminated.

Figure 6:
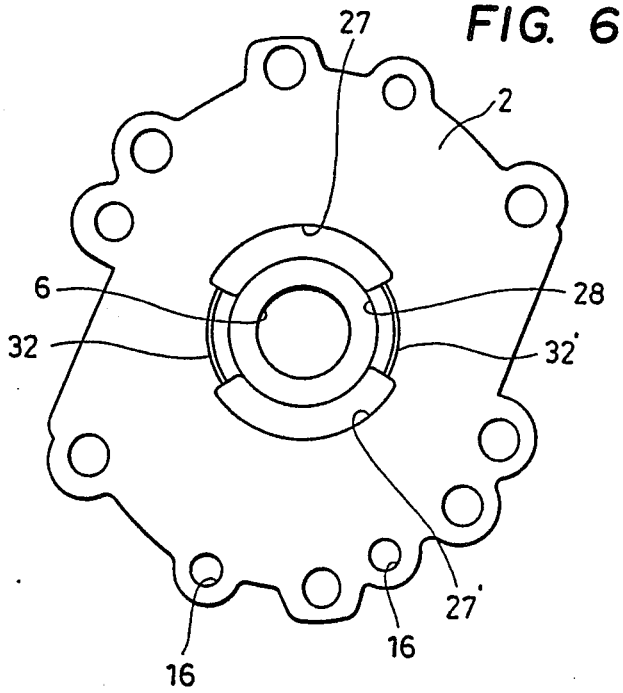
FIG. 6 is a front elevational view of a side block according to a third embodiment of the present invention.

FIG. 6 shows a restrictor means according to a third embodiment of the invention. The restrictor means comprises restrictor slits 32, 32' defined in the side blocks 2, 2' and extending circumferentially with both ends communicating with the oil grooves 27, 27'. The oil in the back-pressure chambers 26 returns through the restrictor slits 32, 32' into the oil grooves 27, 27'.

Figure 7:
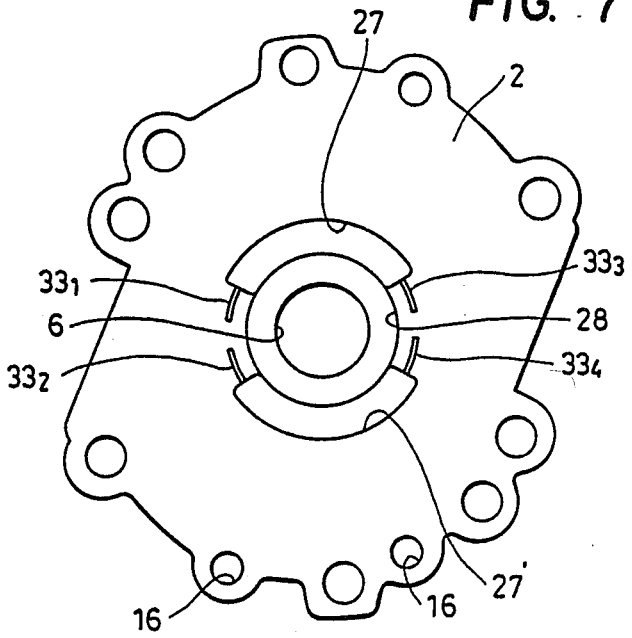
FIG. 7 is a front elevational view of a side block according to a fourth embodiment of the present invention.

According to a fourth embodiment of the invention illustrated in FIG. 7, a restrictor means comprises restriction slits $33_{1-4}$ defined in the side blocks 2, 2' and each having one end communicating with the oil grooves 27, 27' and the other end terminating in the end surfaces of the side blocks 2, 2'. As with the third embodiment, the oil in the back-pressure chambers 26 returns through the restrictor slits $33_{1-4}$ into the oil grooves 27, 27'.

Figure 8:
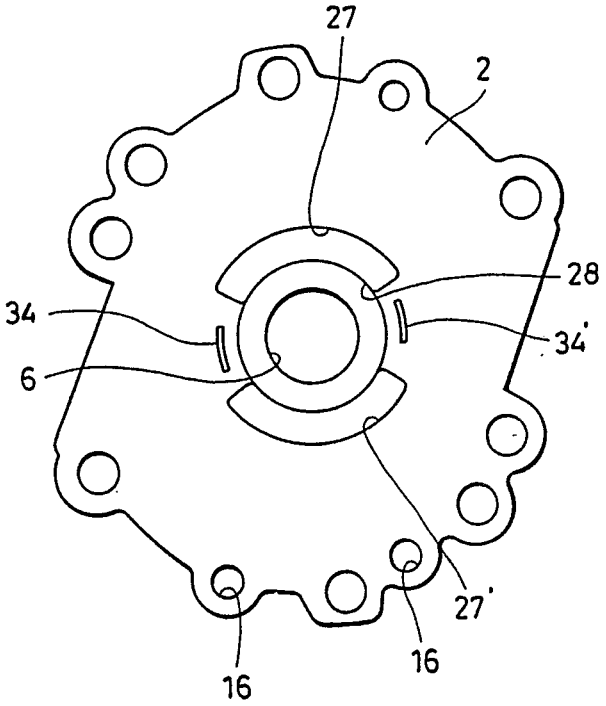
FIG. 8 is a front elevational view of a side block according to a fifth embodiment of the present invention.

FIG. 8 illustrates a fifth embodiment of the present invention, in which a restrictor means is composed of restriction slits 34, 34' defined in the side blocks 2, 2' out of communication with the oil grooves 27, 27', and clearances between the side blocks 2, 2' and the rotor 5. The oil in the back-pressure chambers 26 thus flows back into the oil grooves 27, 27' through the slits 34, 34' and the clearances.

In all of the foregoing embodiments, the side blocks 2, 2' have oil guide grooves 28. Where a sufficient amount of oil can be led into the oil grooves 27, 27' via the clearances between the side blocks 2, 2' and the rotor 5, no such oil grooves 28 are required.

With the arrangement of the present invention, the back-pressure adjustment device is capable of increasing the back pressure acting on the vanes while they are moving across the pump outlets, thus preventing chattering of the vanes. Accordingly, abnormal sounds caused by vane chattering can also be prevented. Since the vanes do not hit the cylinder, their service life is prolonged. The oil grooves in the back pressure adjustment device communicate with the oil supply system, but are out of communication with the gas passage system, with the result that no oil will be mixed into the discharged gas. The vanes are pushed radially outwardly under a high pressure properly adjusted by the restrictor means only when the vanes move across the pump outlets. This results in a smaller power loss as compared with conventional vane compressors, and freedom from the danger of seizure in operation.

Although certain preferred embodiments have been shown and described, it should be understood that many changes and modifications may be made therein without departing from the scope of the appended claims.

What is claimed is:

1. A vane compressor comprising:

(a) a compressor body including a cylinder having at least one pump outlet and opposite axial ends, and a pair of side blocks secured to said axial ends of said cylinder and having opposite inner end surfaces;

(b) a rotor rotatably mounted in said compressor body and having opposite end surfaces facing said inner end surfaces of said side blocks, said rotor carrying a plurality of vanes slidably fitted therein, said rotor having a plurality of back-pressure chambers defined therein and surrounded by said vanes and said side blocks, said back-pressure chambers each having opposite axial ends opening in said opposite end surfaces of said rotor;

(c) an oil sump;

(d) said opposite axial ends of each of said back-pressure chambers being disposed to follow a path against each of said opposite inner end surfaces of said side blocks, said path being divided into at least one high-pressure zone through which said vanes move across said pump outlet, and at least one normal-pressure zone;

(e) said opposite inner end surfaces of said side blocks each having at least one oil groove defined therein at a location corresponding to said normal-pressure zone and disposed to communicate with said back-pressure chambers through said normal-pressure zone;

(f) restrictor means provided in said high-pressure zone of said path and communicating with said back-pressure chambers, said restrictor means comprising clearances between said side blocks and said rotor, and completely blind restriction slits defined in said opposite inner end surfaces of said side blocks at locations corresponding to said high pressure zone, said restriction slits being out of communication with said oil grooves;

(g) said rotor having a coaxial drive shaft, and said side blocks of said compressor body having a pair of bearing holes, respectively, in which said drive shaft is rotatably journalled, clearances between said drive shaft and said bearing holes acting to throttle oil flowing therethrough, said side blocks having oil guide grooves defined in said opposite inner end surfaces thereof and communicating between said oil grooves and said bearing holes; and (h) said side blocks having oil supply holes defined therein and communicating with said bearing holes whereby oil fed through said oil supply holes to said bearing holes is then guided at a restricted flow rate through said clearances between said bearing holes and said drive shaft to said oil guide grooves;

(i) wherein while said axial ends of each said back-pressure chambers travel through said normal-pressure zone as said rotor rotates, said oil grooves are in communication with said back-pressure chambers to introduce oil in said oil grooves into said back-pressure chambers, and while said axial ends travel through said high-pressure zone, said back-pressure chambers are out of communication with said oil grooves so that the oil in said back-pressure chambers is substantially confined therein to counter radially inward movement of said vanes as the vanes move past the pump outlet, with a fractional quantity of the oil being allowed to leak through said restrictor means to prevent the vanes from pressing with excessive force against said cylinder.

* * * * *